US005830023A

United States Patent [19]

Brogdon

[11] Patent Number: 5,830,023

[45] Date of Patent: Nov. 3, 1998

[54] MINI FRESH WATER FLUSHING DEVICE

[76] Inventor: Douglas Brogdon, N. Lagoon, Apartment 53, Panama City Beach, Fla. 32408

[21] Appl. No.: 884,686

[22] Filed: Jun. 30, 1997

Related U.S. Application Data

[63] Continuation-in-part of Ser. No. 530,716, Jun. 6, 1995, abandoned.

[51] Int. Cl.[6] ..... B63H 21/10

[52] U.S. Cl. ..... 440/88; 440/113

[58] Field of Search ..... 440/88, 113, 900; 134/166 R, 167 R, 168 R, 169 R, 171, 184; 137/118.02, 118.05, 118.06, 118.07, 112, 113, 315, 338, 367

[56] References Cited

U.S. PATENT DOCUMENTS

| | | | |
|---|---|---|---|
| 4,253,481 | 3/1981 | Sarlis, Jr. | 137/112 |
| 4,467,825 | 8/1984 | Boyd | 137/112 |
| 4,614,202 | 9/1986 | Halvorsen et al. | 137/118.02 |
| 5,393,252 | 2/1995 | Brogdon | 440/88 |

*Primary Examiner*—Ed. L. Swinehart
*Attorney, Agent, or Firm*—Carnes Cona & Dixon

[57] ABSTRACT

The present invention provides for a fresh water flushing device for a marine engine system in a boat for use whether the boat is in or out of the water. The system comprises a valve enables water to be dispensed to the various locations and various components of a marine engine system to provide for fresh water fluid flow within the engine.

5 Claims, 4 Drawing Sheets

MINI FRESH WATER FLUSHING DEVICE

This is a Continuation-In-Part of application Ser. No. 08/530,716, filed Jun. 6, 1995, now abandoned.

BACKGROUND OF THE INVENTION

1. Field of the Invention

The present invention relates generally to a fresh water flushing device for marine engines and more particularly to a fresh water flushing device compact in size and that expels entrained raw water from raw water cooling conduits of marine engines, in a reverse cooling flow cycle, including engines on: auxiliary devices like air conditioners, generators and heat exchangers; personal watercraft like jet skis and water bikes; and smaller outboards. Fresh water may expel raw water from conduits of engines wherever engines may be mounted and irrespective of whether engines are running or stopped.

2. Description of the Prior Art

Throughout the United States efforts are being taken to improve fresh water flushing devices for marine engines. The primary object of the present invention is to allow operators of motor vessels to flush the raw water entrained in engines after the engines are stopped. Every marine engine manufacturer recommends fresh water flushing. Flushing fresh water through marine engines substantially lowers maintenance costs, prolongs engine life and protects the significant investment in the engines.

Current flushing devices treat cooling devices as single cavities, as opposed to groups of cavities, water pathways and other equipment. Traditional flushing devices now available are cumbersome and time consuming to use, likely to produce error, and in many cases not feasible for use with smaller outboard engines, personal water craft including jet skis and water bikes, and auxiliary devices including air conditioners, generators and heat exchangers.

For example, most flushing devices cannot be used if the vessel and engine are lifted from the water on a davit or are stored in a boathouse. Current flushing equipment usually requires the engine to be running while the boat remains in or near the water. Under certain condition, flushing engines can be hazardous. The current flushing devices have limitations on convenience and reliability that make them user unfriendly. Most current devices merely relocate mineral and salt residues to other locations within the cooling device.

SUMMARY OF THE INVENTION

The present invention is a mini fresh water flushing system, having an assembled size of approximately less than five inches in length. This compact size is ideal smaller outboard engines, personal water craft including jet skis, water bikes, or the like, and auxiliary devices of water vessels, including air conditioners, generators, heat exchangers, and the like. The unique design and configuration of the present invention provides a device which can be utilized for displacing raw water in a marine engine or auxiliary device of a water vessel, whether the vessel remains in or out of the water.

In allowing the water to flow, the mini fresh water flushing device provides for a reverse cooling flow cycle. When a sea vessel is in operation, raw sea water is used for cooling the engine and its components. The raw sea water enters the sea vessels and travels through out various locations for adequately cooling the engine and its components. This process must occur for properly operating the vessel.

The present invention will flush this raw water from the various locations and will do so in the reverse direction. Basically, the raw sea water is force out of the engine and/or auxiliary components in the reverse direction. In this arrangement, the reverse flow of clean water will provide for the salt water or raw water and sediment to travel from the engine block and to the drain for exit as oppose to from the drain to the engine for exit. This arrangement will provide for less salt and sediment to travel within the engine when the cleaning process is enforce, thus providing a more effective and efficient cleaning process.

The fresh water flushing device of the present invention comprises a unit which may be mounted permanently on the vessel. The flushing device assembles with two sections. The first section includes an inlet for fresh water supply connection and at least one access port. The at least one access port will be coupled to the appropriate area of the existing engine block, as suggested by the engine manufacturer. The number of access port is dependent upon the area(s) needed to be flush. This number will vary since flow of fresh water is proportionately discharged toward appropriate points on the marine engine where flushing water would perform optimally varies from one engine to another.

On the second section, the flushing device includes a reverse cycle flush port that remains connected to a conventional discharge port located on the existing engine for normal marine engine operation. During flushing operation, this reverse cycle flush port will receive flushing water for properly allowing flushing to occur.

Accordingly, it is an object of the present invention to provide a fresh water flushing device to expel entrained raw water from raw water cooling conduits of marine engines whether vessels remains in or out of the water.

It is another object of the present invention to provide a fresh water flushing device that works with a variety of marine engines and their components for successfully and efficiently cleaning and flushing raw water from the engine.

Still another object of the present invention is to provide a fresh water flushing system, compact and mini in size, which will provide for a reverse flow cycle when flushing occurs, inherently providing a more proficient means of flushing as well as inherently increasing the life of the engine and avoiding any further contact between the raw sea water and sediment and engine.

It is yet another object of the present invention to provide a fresh water flushing device that can be easily retrofitted into existing vessels.

Still another object of the present invention is to provide a fresh water flushing device that proportions the flow of fresh water to each component of the cooling equipment to ensure complete and correct flushing harmful minerals, salts and other residues from the cooling equipment.

Still a further object of the present invention is to provide a fresh water flushing device that can be easily incorporated as an Original Equipment Manufactured (OEM) component for newly manufactured vessels.

It is yet another object of the present invention to provide a fresh water flushing device that will resist the corrosive effects of salt air and sea water on the fixed and movable, working parts of the invention.

Another object of the present invention is to provide a fresh water flushing device that will not impair the operational performance of the marine engine when the fresh water flushing device remains conjoined with the marine engine.

Still another object of the present invention to be specifically enumerated herein to provide a mini fresh water flushing device in accordance with the preceding objects and which will conform to conventional forms of manufacture, be of simple construction and easy to use so as to provide a device that would be economically feasible, long lasting and relatively trouble free in operation.

Although there have been inventions related to flushing devices, none of the inventions have become sufficiently compact, low cost, and reliable enough to become commonly used. Prior techniques do not offer a device which allows flushing to occur in the reverse direction of the cooling system. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENT

The present invention is a mini fresh water flushing system designed and configured to flush fresh water through a marine engine and/or auxiliary components in a reverse direction. Conventionally, raw water is used to cool the engine during normal operation. Normal operation being the time of utilizing the device. Water flow is conventional and typically water flow for cooling travels from the pick-up to the water pump. From the pump, water travels to the transfer tube and then to a common housing. From the common housing, the water flows to the engine block, to the heads, and then to the exhaust manifold. From the exhaust manifold, water escapes from a visual discharge via a discharge line.

The pick-up is also known as the point where raw water is ingested into the marine engine. The common housing is also known as the adapter plate. The adapter plate is used to connect the drive mechanism to the engine. All the components listed above are conventional and the cooling process, like the components, is conventional.

The present invention will flush the engine of the raw water and sediment in a reverse direction. Reverse direction being reverse in flow from the cooling process. Hence, the flushing of fresh water will occur by allowing the fluid to flow from the discharge to the exhaust manifold via a discharge line. From the manifold the fluid travels to the head and then to the engine. From the engine, the fluid travels to the common housing, then to the transfer tube, the water pump and finally exists the pick-up. The reverse process allows the sediment and raw water to exit the drain, as opposed to the engine. This process is more efficient in cleaning and will prolong the life of the conventional marine engine.

Figure 1:
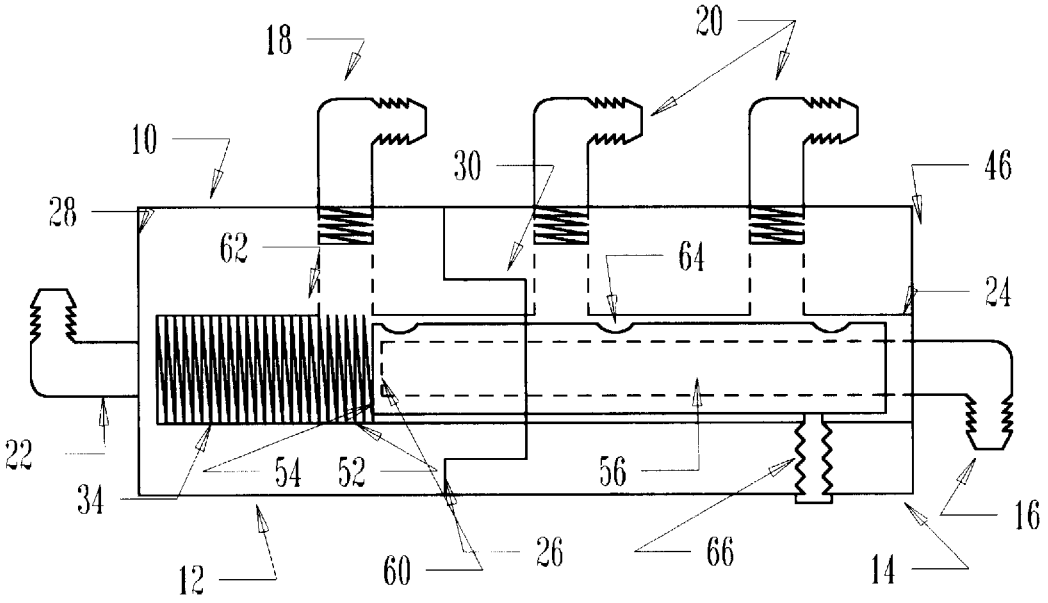
FIG. 1 is a cross sectional view of the mini fresh water flushing device of the present invention in a rest or closed position.
Figure 2:
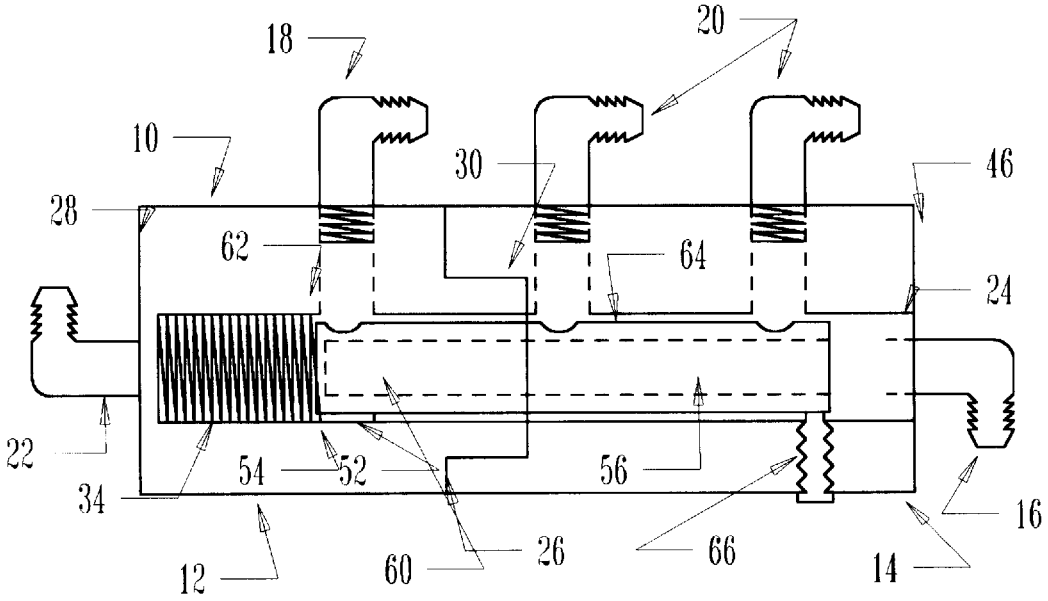
FIG. 2 is a cross sectional view of the mini fresh water flushing device of the present invention in a compressed or opened position.
Figure 3:
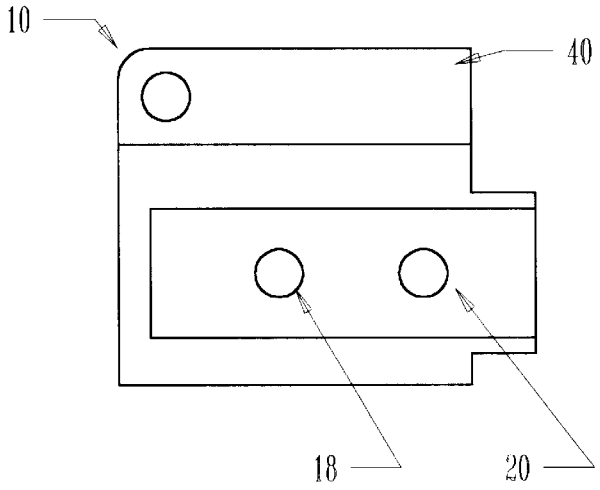
FIG. 3 is a top planar view of the first end cap used in the mini flushing device of the present invention.

FIGS. 1 and 2 illustrates the flushing device of the present invention. As seen in these figures, the flushing device 10 comprises a end cap 12 and a second end cap 14. The first end cap 12 includes a reverse cycle outlet port 18 and an reverse cycle outlet 22, while the second end cap 14 includes at least one access ports 20. A diverter 24 is slidably located within the first end cap 12 and second end cap 14. Hose or tube fittings connect and seal to the various ports by any suitable connection means, preferably by external, straight threads on fitting mating with internal, straight threads on ports (as illustrated).

The first end cap 12 is illustrated in further detail in FIGS. 1–4 and 6. As seen in these figures, the first end cap 12 includes a first end 26 and an enclosed back wall 28. This enclosed back wall 28 is located oppositely from the first end 26. Extending outwardly from the first end 26 is a male portion 30. The first end cap further includes a bore 32. This bore 32 extends from the male portion 30 to the proximity of the enclosed back wall 28, but not through the enclosed back wall. The bore 32 provides for an interior area to be located within the first end cap 12 and is adapted to receive the diverter 24.

The bore 32 in the first end cap 12 is sized appropriately so the diverter 24 slides freely in the bore 32 (illustrated in outline in FIG. 4), but substantial amounts of water cannot pass through the annulus created by the outside surface of the diverter 24 and the bore 32 of the first end cap 12. Ideally, no water would pass through the annulus created by the outside surface of the diverter 24 and the bore 32 of the first end cap 12.

As seen in FIGS. 1 and 2, a spring 34 is located between the enclosed back wall 28 and the back portion of the diverter 24. This spring 34 aids in the transitional movement of the diverter 24 located within the bore 32. The reverse cycle outlet 22 extends from the bore 32 and outwardly from the enclosed back wall 28. The reverse cycle outlet port 18 extends from the bore 32 and upwardly through the first end cap 12.

The reverse cycle outlet port 18 and the reverse cycle outlet 22 are designed to be coupled to the existing discharge and discharge line, respectively. FIG. 1 illustrates the drawing during normal operation of the marine vessel, while FIG. 2 illustrates the invention 10 aligned for flushing operations. As seen in normal use, the reverse cycle outlet port 18 is in fluid communication with reverse cycle outlet 22. This arrangement, during normal use, will provide for cooling water to flow from the reverse cycle outlet to the discharge via 22 and 18, respectively. This configuration will not cause a disrupting during normal operation or normal cooling operation. Hence, it is seen that the mini flush of the present invention is located between the discharge line and discharge of the conventional boat. As shown in the drawings, flushing with fresh water will occur when the spring is compress (shown in FIG. 2), while normal operation of the engine will occur when the device is not in use (shown in FIG. 1) and the spring is extended or in a none compressed state. Normal fluid flow with raw water, such as from the sea, lake, river, or the like, can continue during normal operation via outlet 22 and port 18, respectively.

The first end cap 12 is adapted to receive the second end cap 14. This second end cap 14 is illustrated in further detail in FIGS. 1, 2, 5 and 6. As seen in these figure, the second end cap 14 includes a first end 44 and an enclosed front wall 46. Extending inwardly from the first end 44 is a female receiving portion 48. This female receiving portion 48 is adapted to receive and maintain the male portion 30 of the first end cap 12.

The second end cap 14 further includes a second bore 50 which extends from the female receiving end to the proximity of the enclosed front wall 46, but not through the enclosed front wall 46. This second bore 50 provides for an interior area to be located within the second end cap 14. Once the first end cap is secured to the second end cap, the first bore 32 will be aligned with the second bore 50. These bores will be adapted to receive the diverter 24 to enable the diverter 24 to move linearly within the bores, 32 and 50, respectively.

The second bore 50 is sized appropriately like the bore in the first end cap 12 so that the diverter slides freely within the first and second bores, but substantial amounts of water cannot pass through the annulus created by the outside surface of the diverter and the second bore of the second end cap 14.

The inlet port 16 extends from the second bore 50 and outwardly through the enclosed front wall. This inlet port 16 permits the user to attach a conventional fresh water source to the flushing device 10 of the present invention. At least one access port 20 extends from the second bore 50 and upwardly through the second end cap 14. The at least one access port will be coupled to an access point of the marine engine, as recommended by the manufacturer. Typically, these access points include fittings, plug or passage way in the existing engine block.

Figure 4:
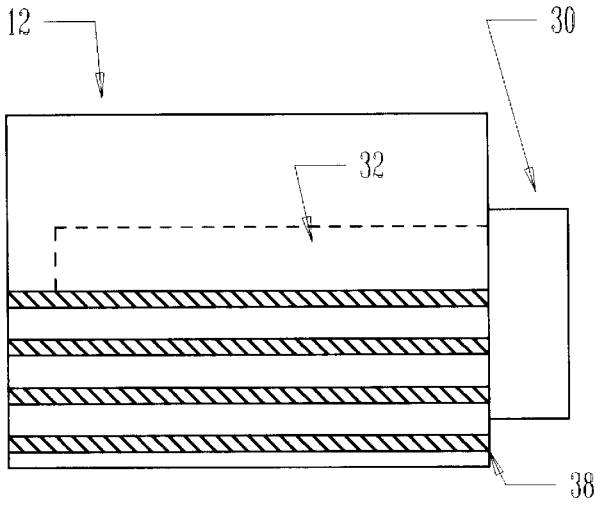
FIG. 4 is a side planar view of the first end cap used in the mini flushing device of the present invention.
Figure 5:
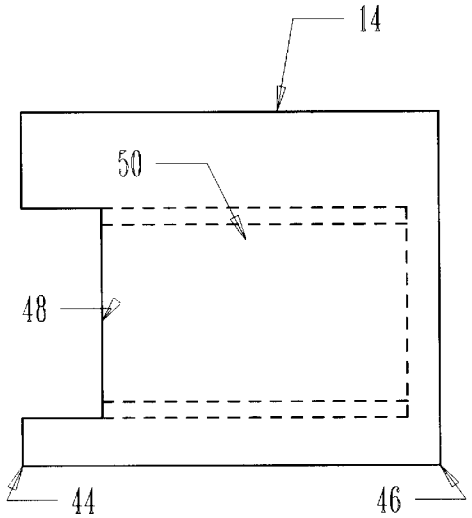
FIG. 5 is a side planar view of the second end cap used in the mini flushing device of the present invention.
Figure 6:
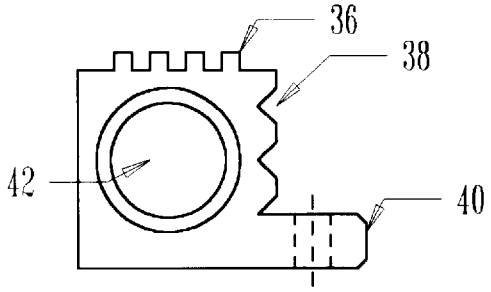
FIG. 6 is a front planar view of the second end cap used in the mini flushing device of the present invention.

Exteriorly, each end cap 12 and 14, respectively, as seen in FIGS. 4 and 6, further include a plurality of square or V-shaped grooves 38, radiator vanes 36, or a combination thereof. These grooves and/or vanes are used for heat transfer as well as provide for an aesthetically pleasing product. The first end cap and/or second end cap further includes a flange 40 having at least one through hole extending therethrough. These through holes are used for attaching the flushing device 10 to a conventional boat, or the like.

The enclosed end of the first end cap and the enclosed end of the second end cap each include an opening (illustrated in FIG. 6 and labeled as 42) that is adapted to be aligned with the reverse cycle outlet 22 and the inlet port 16, respectively.

The diverter 24, which is located within the first end cap 12 and the second end cap 14, is illustrated in further detail in FIGS. 1 and 2. The diverter is designed to slide horizontally within the first and second end caps to provide for either a first position or a second position to exist. In the first position, illustrated in FIG. 1, normal operation of the cooling system occurs. In a second position, illustrated in FIG. 2, flushing with fresh water will occur within the marine engine.

As seen in FIGS. 1–6, the diverter 24 has a substantially elongated, cylindrical shape. The diverter includes a first interior portion or bore 52 which extends inward from a first end 54 of the diverter 24 and a second interior portion or bore 56 which extends inward from a second end 58 of the diverter 24. Preferably, the axis of the interior portions or bores match the axis of the diverter for manufacturing simplicity. The second portion or second bore 56 of the diverter 24 terminates before meeting the first portion or first bore 52 of the diverter 24, leaving a medial wall 60 between the bores.

The first end 54 and the second end 58 of the diverter 24 each include openings that are adapted to align with the reverse cycle outlet 22 and the inlet port 16, respectively. Located on the encompassing side wall of the diverter 24, in the area of the first portion 52 a first hole or first metering port 62. Located on the encompassing side wall of the diverter 24, in the area of the second portion 56 are a plurality of metering ports 64.

The plurality of metering ports 64 are adapted to align with the reverse cycle outlet port 18 and access port(s) 20 once the device in an opened position or second position (the spring 34 is in a compressed state, as illustrated in FIG. 2). In this second position flushing with fresh water will occur. In a second position, the first metering hole 62 is adapted to align with the reverse cycle outlet port 18, while the metering holes 64 are displaced with the metering ports 20 when the device is in a closed position (the spring 34 is expanded, as illustrated in FIG. 1). This arrangement will provide for the holes not to align with the access port or the reverse cycle outlet port, thereby not permitting fluid flow within this second portion 56. In this position, normal operation of the cooling means will occur. The raw water will flow in the first portion 52 via reverse cycle outlet 22 and reverse cycle outlet port 18.

For allowing a smooth transition, the diverter 24 further includes a longitudinal slot (not illustrated), where a set screw 66 slidably rests. This longitudinal slot and set screw 66 are located on the encompassing side wall of the diverter, oppositely from the metering ports 62. The slot and screw do not breach the first or second interior portions or bores 52 and 56, respectively, and may be alternately located in other places, provided interference with metering functions can be avoided. The use of the longitudinal slot and set screw will provide a means for smooth linear and horizontal transition.

The diverter 24 is oriented during assembly so the first portion or bore 52 rests within the first end cap 12 and the second portion or bore 56 rests in the second end cap 14.

The spring 34 is a compression spring and rests, when assembled in the flushing device 10, slightly compressed within the first end cap 12. This spring is located between the enclosed back wall 28 of the first end cap and the first end 54 of the diverter 24. This will provide for the spring 34 to abut both the enclosed back wall 28 and the first end 54.

When assembled, the spring 34 urges the displacement of the plurality of metering ports 64 of the diverter with respect to the access ports 20. This will provide for normal operation of the cooling system, as shown in FIG. 1. During fresh water flushing operation, a water source is connected to the inlet port 16. This will render rising pressure of flushing water at the inlet port 16, in the second portion or bore 56, and the second end 58 of the diverter 24. This pressure will create a sufficient force in order to compress the spring 34 and move the diverter toward the enclosed back wall 28 of the first end cap 12.

Various pressures create various forces, which counteract and then match various spring forces, such that the diverter 24 balances at various positions. Higher pressures, naturally, result in greater compression of the spring 34 and greater movement of the diverter 24 toward the enclosed back wall 28 of the first end cap 12. Lower pressures, naturally, result in lesser compression of the spring 34 and lesser movement of the diverter 24 toward the enclosed back wall 28 of the first end cap 12.

The spring 34 preferably has a progressive spring rate, beginning to compress further from initial state when the pressure of flushing water reaches about seven pounds per square inch and compressing to closed or stacked height above fifty pounds per square inch, but also moving different distances for similar incremental changes in pressure, depending on whether the spring is slightly compressed or mostly compressed. The diverter 24 cannot move further toward the enclosed back wall 28 of the first end cap 12 when the spring 34 reaches closed or stacked height. Spring rates preferably act in concert with metering port design and size to optimize particular applications of the flushing device, providing appropriate flushing water flow regulation for engines on which the flushing device is conjoined.

After the diverter 24 and spring 34 are oriented and placed in respective proper positions, the second end cap 14 adheres by glue, weld or other connection means to the first end cap 12, with the male portion 30 of the first end cap 12 engaging the female portion 48 of the second end cap 14. Should repairability of the flushing device 10 be desired, connection means may include bolts or screws, or the first end cap 12 and second end cap 14 may include appropriate threads so the caps would threadably engage. The bore 32 of the first end cap 12 and the bore 50 of the second end cap 14 align precisely to form a continuous bore where the diverter 24 may reciprocate linearly, regardless of the connection means.

The second end cap 14 may includes a threaded bore with an axis oriented radially to the bore. The threaded bore accepts the set screw 66, which includes an end that is received in the slot located in the diverter, allowing the diverter to slide freely, linearly, but not rotate in the continuous bore formed by the first bore 32 of the first end cap 12 and the second bore 50 of the second end cap 14. The set screw 66 ensures the metering ports 64 can align with the access port(s) 20 and the reverse cycle outlet port 18.

The medial wall 60 and metering ports 64 have a location important to proper operation of the flushing device 10. When the diverter 24 rests, the spring 34 is compressed, the metering ports 64 and access port(s) 20 misalign, so liquid flow cannot pass through the metering ports into the access ports. In this configuration, the reverse cycle outlet port is aligned with the first metering port for allowing normal cooling operation will occur.

Rising pressure of the flushing water by way of the inlet port 16 moves the diverter 24 toward the enclosed end 28 of the first end cap 12, progressively aligning metering ports 64 with access ports 20 and progressively misaligning the first hole 62 from the reverse cycle outlet port 18.

When the spring 34 is compressed, fresh water flushing may occur. With fresh water flushing, the metering ports 64 align wholly with the reverse cycle outlet port and access port(s) 20 so maximum flow may pass from the inlet port 16 through the second bore 56 of the diverter 24, through the metering ports 64, into the reverse cycle outlet port and access ports 20. Fresh water can then flush the system in a direction reverse from the direction for cooling the engine. The medial wall prevents water to escape to the reverse cycle outlet. Fresh water is forced to flow from the discharge to the exhaust manifold via the discharge line. From the manifold the fluid travels to the head and then to the engine. From the engine, the fluid travels to the common housing, then to the transfer tube, the water pump and finally exists the pick-up.

When pressure rises above about fifty pounds per square inch the diverter 24 misaligns metering ports 64 from access ports 20 and prevents flow to the access ports, the metering ports 64 having completely passed the access ports 20, providing safety where pressure at the access ports 20 cannot rise above fifty pounds per square inch due to flow from the inlet port 16 without possibly causing marine engine damage.

Fresh water, from the inlet port 16 in the second end cap 14, flows through the second bore 56 of the diverter 24 and through the plurality of metering ports 64 on route to the access ports 20 and reverse cycle outlet port 18 when flushing. When not flushing, cooling water flows through the first bore 52 of the diverter on route to the reverse cycle outlet and reverse cycle outlet port, maintaining normal and proper cooling operation.

The flushing device includes schematically a plurality of normally closed regulating elements and a normally open regulating element. The access port(s) 20 of the second end cap 14, the metering ports 64 of the diverter 24 and the spring 34 form the normally closed elements. The reverse cycle outlet port 18 of the first end cap 12, the first hole 62 of the diverter 24 and the spring 34 form the normally open element. When pressure at the inlet port 16 and the second bore 52 remains below about seven pounds per square inch, flow cannot pass from the inlet port 16, through the metering ports 64 to the access ports 20; flow can pass from the reverse cycle outlet port 18 through the first hole 62 to the reverse cycle outlet 22. As pressure rises the normally closed elements progressively open and the normally open element progressively closes. When pressure reaches a maximum of about fifty pounds per square inch all elements close.

Prior to utilizing the present invention 10, the user must install the device onto the conventional boat. For installation, the access port(s) 20 is/are are connected to the various points on the engine where flushing liquid most advantageously performs via hoses or the like, and according to the engine manufacturer. The reverse cycle outlet port is coupled to the discharge of a conventional marine engine. The reverse cycle outlet 22 is preferably coupled to the dishrag line of the conventional boat, to enable the normal fluid flow when the device in not in the flushing mode. Hence, for proper operation, the user connects a source of flushing liquid (various purpose like cleaning lubricating or preparing storage may suggest other than fresh water for flushing liquid) to the inlet port 16. Simply introducing flushing liquid in sufficient quantities and at sufficient pressures then commences operation. Length of operation for a particular marine engine in a particular condition depends on desired flushing performance. During non-use of the present invention, the sea water, lake water, or the like, is forced to exit the discharge via the reverse cycle outlet port and the reveres cycle outlet.

The device is compact in size and simple for utilization. The final product being approximately less than 5 inches in length. A product having a length of 4.2 inches has been fabricated and has produced favorable results, however, the size and length can be altered and adjusted accordingly.

While the invention has been particularly shown and described with reference to the embodiments thereof, it will be understood by those skilled in the art that various changes in form and detail may be made without departing from the spirit and scope of the invention.

I claim:

1. A flushing system for a marine engine in a boat for use whether said boat is in or out of a body of water comprising in combination:

a first end cap secured to a second end cap;

a first bore is located interiorly in said first end cap and said first end cap includes a reverse cycle outlet port that extends from the first bore and exteriorly from said first end cap;

a second bore is located interiorly in said second end cap and said second end cap includes at least one access port that extends from the first bore and exteriorly from said second end cap and an inlet port extends into said second bore;

a diverter is slidably located within said first bore and said second bore and said diverter includes a first portion having at least one hole and a second portion including a plurality of holes for providing said at least one hole to be aligned with said reverse cycle outlet port and said plurality of holes are disaligned with said at least one outlet port when flushing is not occurring and said at least one hole is adapted to be disaligned with said access port and said plurality of holes are adapted to be aligned with said reverse cycle outlet port and said at least one access port when flushing is occurring.

2. A flushing system as in claim 1 wherein said first end cap and said second end cap includes a plurality of grooves, vanes or a combination of grooves and vanes for dissipating heat.

3. A flushing system as in claim 1 wherein a groove or slot is located exteriorly in said diverter and said groove or slot is adapted to receive a set screw for enabling controlled movement of said diverter within said first bore and said second bore.

4. A flushing system as in claim 1 wherein a spring is located within said first bore and said spring is compressed when flushing is occurring and said spring is extended when flushing is not occurring.

5. A flushing system as in claim 1 wherein a mounting flange is exteriorly located on said first end cap or said second end cap.

* * * * *